United States Patent [19]

Derosier

[11] 4,299,098

[45] Nov. 10, 1981

[54] REFRIGERATION CIRCUIT FOR HEAT PUMP WATER HEATER AND CONTROL THEREFOR

[75] Inventor: Gregory S. Derosier, Holmen, Wis.

[73] Assignee: The Trane Company, La Crosse, Wis.

[21] Appl. No.: 167,576

[22] Filed: Jul. 10, 1980

[51] Int. Cl.[3] ..... F25B 27/02; F25B 13/00

[52] U.S. Cl. ..... 62/238.6; 62/160; 62/324.6

[58] Field of Search ..... 62/160, 238.6, 324.7

[56] References Cited

U.S. PATENT DOCUMENTS

| | | | |
|---|---|---|---|
| 3,158,006 | 11/1964 | Skeats et al. | 62/324.6 |
| 3,916,638 | 11/1975 | Schmidt | 62/160 |
| 3,994,142 | 11/1976 | Kramer | 62/238.1 |
| 4,240,269 | 12/1980 | Bussjager | 62/324.6 |

*Primary Examiner*—Lloyd L. King

*Attorney, Agent, or Firm*—Carl M. Lewis; Peter D. Ferguson; Ronald M. Anderson

[57] ABSTRACT

A refrigeration circuit is disclosed which is operable in each of four distinct modes for the heating or cooling of a space, the production of a heated liquid, or the simultaneous cooling of a space and production of heated liquid. The circuit includes compressor means; indoor, outdoor, and liquid heat exchange means; along with vapor conduit means including first valve means and liquid conduit means including second valve means so as to afford selective operation of the circuit in any one of the aforementioned modes. A significant feature of the invention lies in the fact that, during operation in any particular mode, the inactive heat exchange means of the circuit is vented to the suction side of the compressor means so as to afford proper refrigerant charge control within the circuit. Control means are further disclosed which sense the load imposed upon the compressor means and prevent overloading thereof during operation in a water heating mode.

12 Claims, 6 Drawing Figures

REFRIGERATION CIRCUIT FOR HEAT PUMP WATER HEATER AND CONTROL THEREFOR

DESCRIPTION

Technical Field

The present invention relates to the art of refrigeration and, particularly, is directed to an improved refrigeration circuit providing not only heating and cooling of space, but also the production of a heated liquid such as hot water for domestic or other purposes.

Background Art

It has heretofore been proposed that a reversible refrigeration system be provided for the heating or cooling of a conditioned space, such systems commonly referred to in the art as heat pumps, a wide variety of which are currently available from a number of manufactures. Moreover, it has been proposed that the heat rejected by a refrigeration system be reclaimed and put to use in the heating of water for domestic or other purposes, which heat would otherwise be rejected to the ambient. Finally, it is recognized that the heating of water using a refrigeration system, even where no use may be made of the cooling effect provided thereby, is inherently more efficient than electrical resistance heating elements for the production of hot water. Accordingly, systems have been proposed in the past strictly for the heating of water using a refrigeration system.

It has further been recognized by the prior art; e.g., U.S. Pat. No. 3,994,142, that when a refrigeration circuit is provided having at least one heat exchange means which must be intermittently operated, a problem of refrigerant charge control is presented requiring some means to insure that the proper quantity of refrigerant is at all times circulating within the system and not trapped within the inactive heat exchange means.

DISCLOSURE OF THE INVENTION

The present invention comprises a refrigeration circuit which combines the functions described immediately above of heating or cooling of a space, the production of a heated liquid, or the simultaneous cooling of a space and production of a heated liquid, thus serving many of the basic necessities of a residence or other inhabited structure in an economical and efficient manner, using but a single piece of equipment. Furthermore, the circuit is so-designed such that a minimum number of valves are provided in order to effect operation in any one of four distinct modes, while further providing for effective refrigerant charge control within the circuit by venting the inactive heat exchange means to the suction side of the compressor means.

The refrigeration circuit includes compressor means; indoor, outdoor, and liquid heat exchange means; and vapor conduit means including first valve means which connect the suction and discharge ports of the compressor means to first flow connections of the respective heat exchange means. Liquid conduit means including second valve means are provided connected to second flow connections of the indoor, outdoor, and liquid heat exchange means. The first and second valve means are selectively positionable so as to direct refrigerant flow within the circuit to any one of four operating modes depending upon In a first mode refrigerant vapor from the compressor is directed to the indoor heat exchange means where it is condensed so as to transfer heat therefrom to a space to be heated, with the condensed refrigerant then being directed to the outdoor heat exchange means for evaporation through heat exchange with an ambient heat sink, the resulting vapor being returned to the compressor. In this mode, the liquid heat exchange means are inactive and vented to the suction side of the compressor.

In a second mode, high pressure refrigerant vapor is directed from the compressor means to the outdoor heat exchange means where it is condensed by heat exchange with the ambient, the resulting condensed refrigerant being passed to the indoor heat exchange means for evaporation by heat exchange with the space to be cooled, and the resulting vapor being returned to the compressor means. Once again, in this mode the liquid heat exchange means is vented to the suction side of the compressor means.

During operation in a third mode, high pressure refrigerant vapor is directed from the compressor means to the liquid heat exchange means for condensation therein by heat exchange with a liquid to be heated, the resulting condensate being passed to the outdoor heat exchange means for evaporation by heat exchange with the ambient, and the resulting vapor being returned to the compressor means. In this mode, the indoor heat exchange means is vented to the suction side of the compressor means.

Finally, a fourth mode of operation is provided wherein high pressure refrigerant vapor is again directed to the liquid heat exchange means for condensation therein through heat exchange with liquid to be heated, the resultant condensate this time being directed to the indoor heat exchange means for evaporation in heat exchange with a space to be cooled, and the resulting vapor being returned to the compressor means. In this mode, the outdoor heat exchange means is vented to the suction side of the compressor.

In the preferred embodiment, the first valve means associated with the vapor conduit means of the circuit comprise two four-way valves, each of which may assume two positions so as to direct refrigerant flow in the desired manner. These four-way valves are conventional, off-the-shelf items which adds to the attractiveness of this circuit from a manufacturing and cost standpoint.

Since, in systems of this type, the load placed upon the compressor means when operating in the third or fourth mode, e.g., when water heating is taking place, may become excessive, it is desirable that control means be provided for sensing the presence of an excessive compressor load and taking steps to reduce that load. This is accomplished in the present invention through the provision of means for sensing the load on the compressor and for directing liquid refrigerant into the inactive heat exchange means in response to a sensed load in excess of a predetermined maximum, in order to reduce the load on the compressor means.

Accordingly, it is a primary object of the present invention to provide a refrigeration circuit operable in any one of four modes for the heating or cooling of a space, the production of a heated liquid, or the simultaneous cooling of a space and production of a heated liquid, while maintaining at all times proper refrigerant charge control within the refrigeration circuit so as to insure proper operation thereof.

It is a further object of the present invention to provide a circuit as described above which utilizes a minimum number of valves in order to effect proper system operation and to use components which are readily available so as to enhance manufacturability and reduce costs.

Yet another object of the invention lies in the provision of control means for preventing excessive loads from being imposed upon the compressor means when operating in a water heating mode.

These and other objects of the invention will become apparent from the following detailed description of the invention and by reference to the accompanying drawings.

BEST MODE FOR CARRYING OUT THE INVENTION

Figure 5:
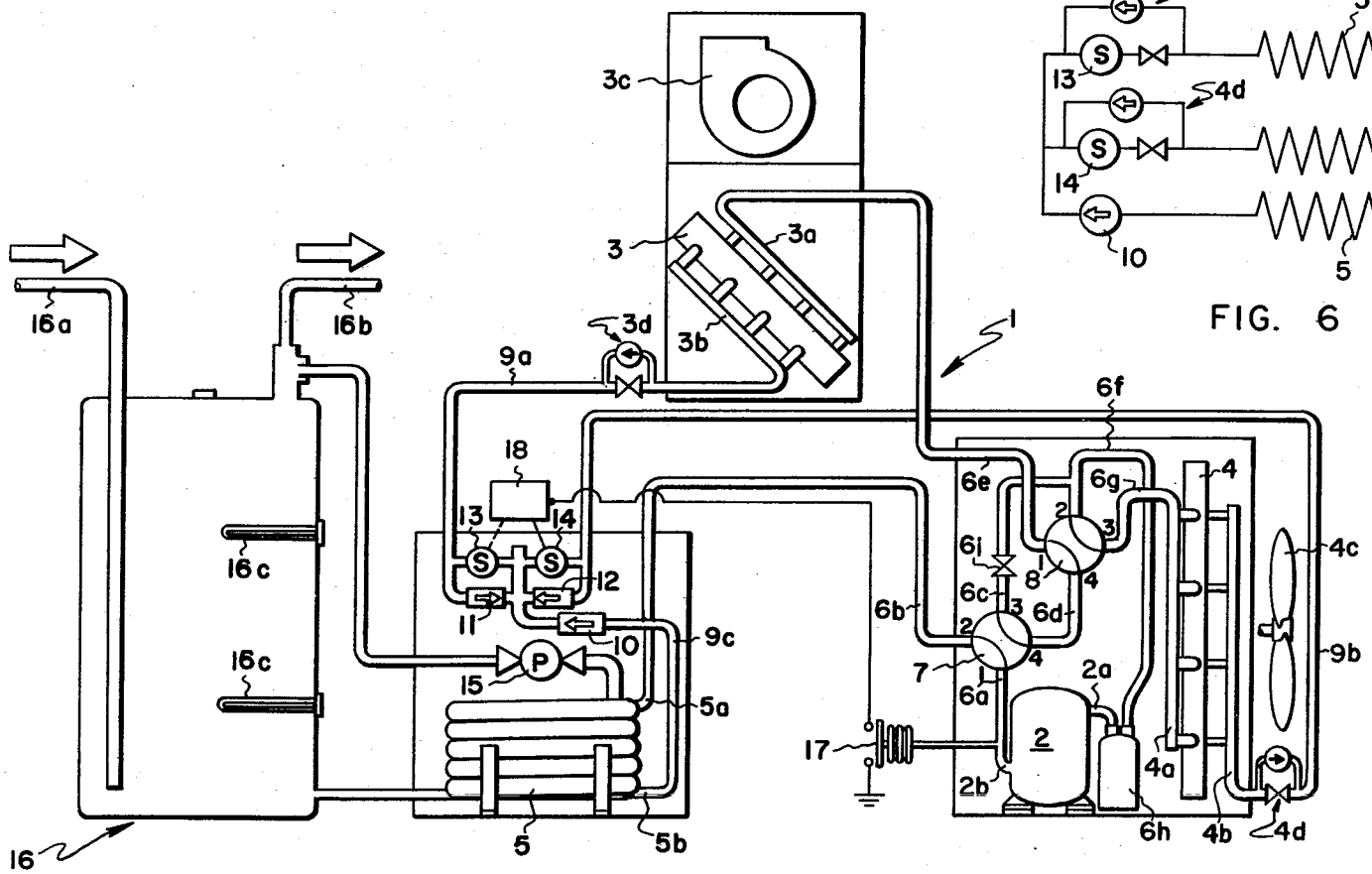
FIG. 5 is an illustration of the refrigeration circuit as it might appear in an actual installation.

Turning first to FIG. 5 of the drawings, the refrigeration circuit comprising the present invention is indicated generally by reference numeral 1 and includes compressor means 2 having a suction port 2*a* and a discharge port 2*b* for compressing a refrigerant vapor. In the preferred embodiment, compressor means 2 would take commercially available today.

Indoor heat exchange means 3 are provided in the form of a conventional fin-and-tube coil having a first flow connection 3*a* and a second flow connection 3*b*, further comprising expansion/bypass means 3*d* as will be described in greater detail below. Indoor heat exchange means 3 are disposed so as to transfer heat between refrigerant flowing therethrough and a space to be heated or cooled; to which end fan means 3*c* are provided for directing air in heat exchange relation with indoor heat exchange means 3.

Outdoor heat exchange means 4 are provided having a first flow connection 4*a* and second flow connection 4*b* which is also of the fin-and-tube type, also including bypass/expansion means at 4*d*, to be described in greater detail below. Fan means 4*c* are provided for directing air over outdoor heat exchange means such that heat may be transferred between refrigerant flowing therethrough and a heat sink, such as the outdoor ambient.

Liquid heat exchange means are provided at 5 and include a first refrigerant flow connection 5*a* and a second refrigerant flow connection 5*b*. Liquid heat exchange means 5 are of the tube-in-a-tube type such that refrigerant flowing within an inner tube may transfer heat to a liquid flowing within an outer, annular tube surrounding the refrigerant-carrying tube. As further illustrated in FIG. 5, a pump 15 is provided for directing liquid between heat exchange means 5 and a hot water heater/storage tank 16 which, if desired, may also include supplemental electrical resistance-type or other backup heating means such as gas or oil heaters 16*c*. Flow connections 16*a* and 16*b* serve to admit and remove water from storage tank 16.

Vapor conduit means 6*a* through 6*g* are connected between suction port 2*a* and discharge port 2*b* of compressor means 2 and the first refrigerant flow connections 3*a*, 4*a*, and 5*a* of the indoor, outdoor, and liquid heat exchange means, respectively. Interposed within vapor conduit means 6*a* through 6*g* are a first four-way valve 7 and a second four-way valve 8 which may be of conventional construction and of the type generally used in heat pump systems. Thus, each of first and second four-way valves 7 and 8, respectively, have valve members which are selectively operable so as to provide communication between the first and second ports (as numbered in FIG. 5) and between the third and fourth ports when in a first position; and between the second and third ports and between the first and fourth ports when in a second position thereof. The operational modes provided through selective positioning of four-way valves 7 and 8 will be discussed in detail by reference to FIGS. 1 through 4 hereinafter.

It should further be noted that the vapor conduit means include means for partially restricting the flow of refrigerant vapor 6*i*, disposed within conduit 6*c*; and a conventional suction line accumulator at 6*h*.

Turning next to liquid conduit means 9*a* through 9*c*, it will be seen that these conduit means interconnect the second refrigerant flow connections of indoor heat exchange means 3, outdoor heat exchange means 4, and liquid heat exchange means 5. It will further be noted that liquid conduit means 9*a* through 9*c* include second valve means 10 through 14 for directing refrigerant flow within the refrigeration circuit in a desired mode of operation. Specifically, a first check valve 11 is provided for preventing flow into the second flow connection of indoor heat exchange means 3, a second check valve 12 is provided for preventing the flow of refrigerant into the second flow connection of outdoor heat exchange means 4, and a third check valve 10 is provided for preventing flow into the second flow connection of liquid heat exchange means 5. Selectively operable bypass valve means are also provided in the form of a first bypass valve 13 connected in parallel with first check valve 11, and second bypass valve 14 connected in parallel with second check valve 12.

With the foregoing refrigeration circuit in mind, reference may now be made to FIGS. 1 through 4 which comprise simplified schematic diagrams of the circuit and illustrate in heavy line the refrigerant flow within the circuit during operation and modes 1 through 4, respectively.

Figure 1:
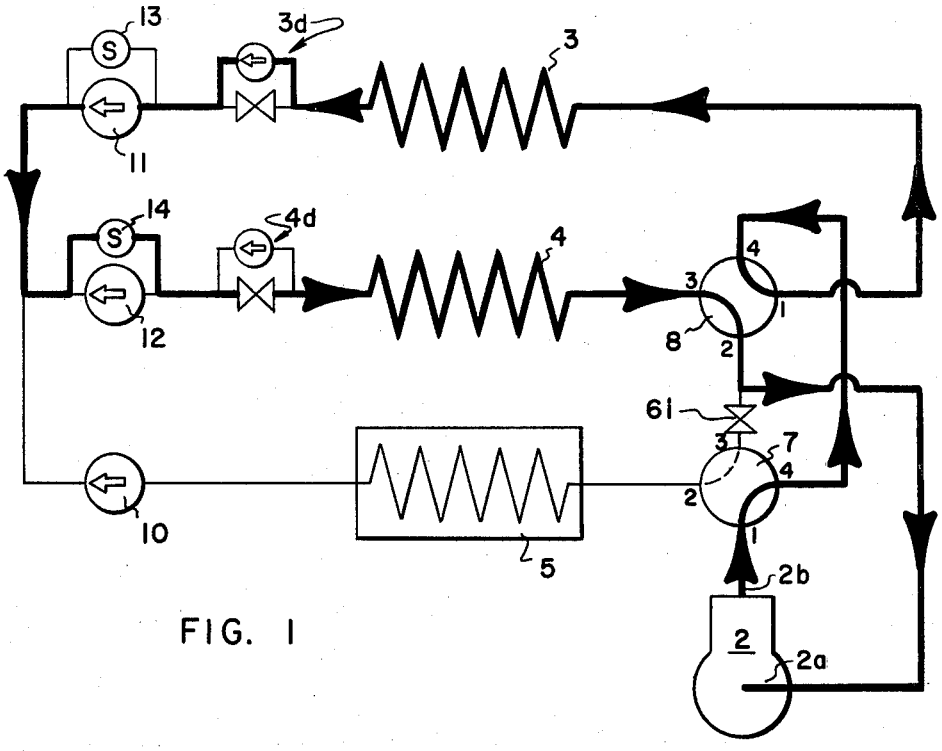
FIGS. 1 through 4 of the drawings are simplified schematic diagrams of the refrigeration circuit comprising the present invention, with the heavy-lined portions thereof denoting refrigerant flow when operating in the first, second, third, and fourth modes, respectively.

Turning then to FIG. 1, the circuit is illustrated in a first mode wherein the circuit is operative for heating a space. As shown in heavy line in FIG. 1, first and second four-way valves 7 and 8, respectively, are both placed in their second positions such that high pressure vapor from compressor means 2 is directed via four-way valves 7 and 8 to the first flow connection of indoor heat exchange means 3, wherein said vapor is condensed so as to transfer heat therefrom to the space to be heated. The thus condensed refrigerant leaves indoor heat exchange means 3 via its second flow connection, passing through the check valve associated with bypass/expansion means 3*d*, via first check valve 11, second bypass valve 14, and through the expansion means associated with expansion/bypass means 4*d* to the second flow connection of outdoor heat exchange means 4. The condensed refrigerant having been reduced in pressure by the expansion means, evaporates in outdoor heat exchange means 4, absorbing heat from the heat sink associated therewith. The resulting low pressure vapor then passes via second four-way valve 8 to the suction port of compressor means 2. It should be especially noted from FIG. 1 that during operation in the first mode, condensed refrigerant is prevented from entering liquid heat exchange means 5 by third check valve 10, while the first flow connection of liquid heat exchange means 5 is vented by first four-way valve 7 to the suction port of compressor means 2. Thus, any liquid refrigerant which may have been initially present in heat exchange means 5 will be evaporated and withdrawn therefrom so as to maintain the proper amount of refrigerant within the circuit for proper operation thereof. It should further be noted that means are provided in the form of flow restriction 6*i* for at least partially restricting the flow of refrigerant vapor which is being vented from liquid heat exchange means 5. In practice, this restriction could comprise any type of flow restricting orifice, valve, or could simply be a length of tubing having reduced cross-sectional flow area.

Figure 2:
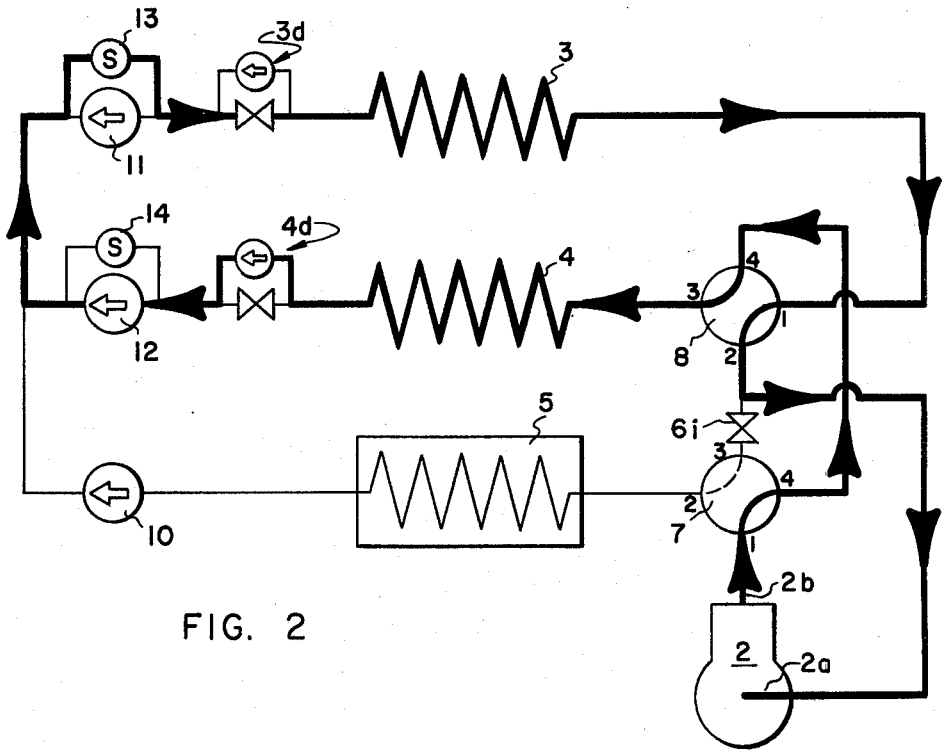

FIG. 2 of the drawings illustrates the refrigeration circuit of the present invention in a second mode wherein cooling of a space is required, and wherein first four-way valve 7 remains in its second position while second four-way valve 8 is moved to a first position such that high pressure refrigerant vapor from compressor means 2 is directed to the first flow connection of outdoor heat exchange means 4 wherein it is condensed by heat exchange with a heat sink, the resulting condensate then passing via the bypass check valve associated with bypass/expansion means 4*d*, through second check valve 12, first bypass valve 13, and through the expansion means associated with bypass/expansion means 3*d* to the second flow connection of indoor heat exchange means 3. The condensed refrigerant evaporates within indoor heat exchange means 3 so as to absorb heat from the space to be cooled, with the resulting low pressure vaporized refrigerant being directed via second four-way valve to the suction port of compressor means 2. As in first mode operation, condensed refrigerant is prevented from entering the second flow connection of liquid heat exchange means 5 by third check valve 10, while the first flow connection thereof is vented to the suction port of the compressor so as to provide proper refrigerant charge control as discussed above.

Figure 3:
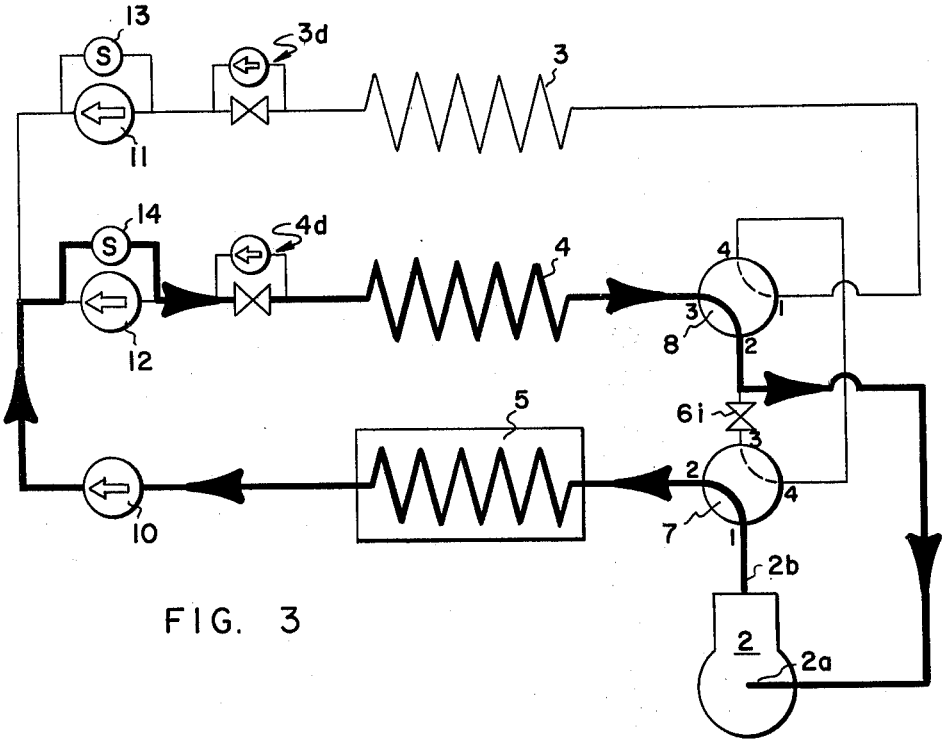

Turning next to FIG. 3 of the drawings, the circuit is illustrated in a third mode wherein a heated liquid such as domestic hot water may be produced. In this mode, first four-way valve 7 assumes a first position so as to direct high pressure refrigerant vapor from a compressor means 2 to the first flow connection of liquid heat exchange means 5 wherein the vapor is condensed and heat is transferred therefrom to a liquid such as domestic hot water, the resulting condensed refrigerant passing via third check valve 10, second bypass valve 14, and expansion means associated with expansion/bypass means 4*d* to the second flow connection of outdoor heat exchange means 4. Here the condensed refrigerant is vaporized and absorbs heat from a heat sink, the vapor passing therefrom via second four-way valve 8 to the suction port of compressor means 2. During operation in the third mode, condensed refrigerant is prevented from entering the second flow connection of indoor heat exchange means 3 by first check valve 11 (first bypass valve 13 being in a closed position), while the first flow connection of indoor heat exchange means 3 is vented via second four-way valve 8 and first four-way valve 7 to the suction port of compressor means 2. Once again, the path for such venting includes means for at least partially restricting flow of refrigerant vapor therethrough at 6*i*. Thus, during operation in the third mode, any liquid refrigerant present within indoor heat exchange means 3 would be evaporated and returned to the refrigeration circuit so as to insure proper charge control therein.

Figure 4:
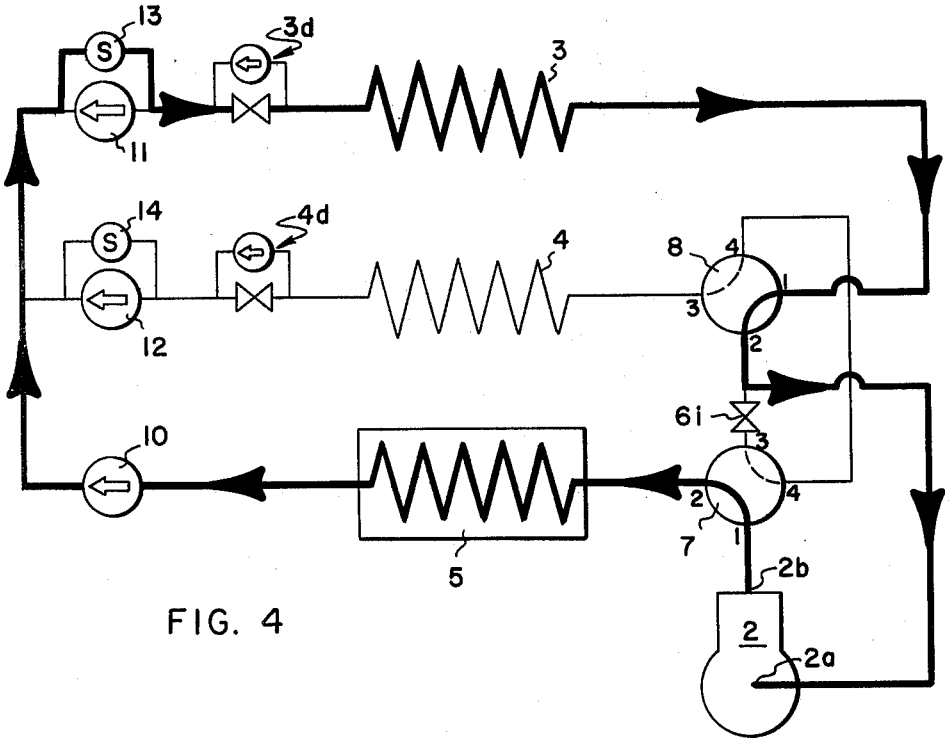

Finally, by reference to FIG. 4 of the drawings, it will be seen that the refrigeration circuit of the present invention is further operable in fourth mode for the simultaneous cooling of a space and production of a heated liquid. In this mode, first and second four-way valves 7 and 8, respectively, each assume a first position such that high pressure refrigerant vapor is directed from compressor means 2 to the first flow connection of liquid heat exchange means 5 for condensation therein and the transfer of heat to a liquid to be heated, such as domestic hot water. The condensate leaves liquid heat exchange means 5 via third check valve 10, first bypass valve 13, and the expansion means associated with expansion/bypass means 3*d*, entering indoor heat exchange means 3 via its second flow connection. Herein the liquid refrigerant is evaporated by heat exchange with the space to be cooled, the resultant vapor being directed via second four-way valve 8 to the suction port of compressor means 2. In this mode, condensed refrigerant is prevented from entering the second flow connection of outdoor heat exchange means 4 by second check valve 12 (second bypass valve 14 being in its closed position), while the first flow connection of outdoor heat exchange means 4 is vented to the suction port of compressor means 2 via second four-way valve 8 and first four-way valve 7 so as to maintain charge control as discussed above.

As should be apparent from the preceding discussion, the refrigeration circuit disclosed herein exhibits the versatility required to operate in four distinct modes, depending upon the particular conditions encountered and demands of a particular installation. Moreover, the circuit disclosed is relatively simple and employs a minimum number of components in order to effect the refrigerant flow path required. It is believed particularly noteworthy that two conventional four-way reversing valves have been employed in the vapor conduit means in order to direct refrigerant vapor flow with respect to the compressor, and the indoor, outdoor, and liquid heat exchange means so as to provide the multi-mode operating capability, while simultaneously providing the function of refrigerant charge control as described.

Figure 6:
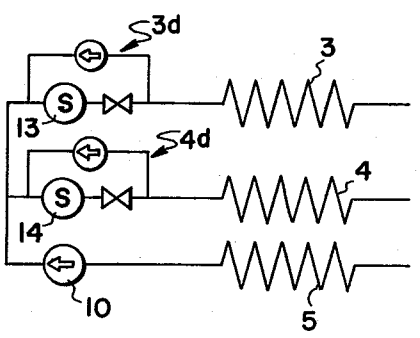
FIG. 6 is a partial circuit schematic illustrating a modified form of the second valve means and liquid conduit means of the invention.

Referring now to FIG. 6 of the drawings, it will be noted that this Figure represents a partial circuit schematic illustrating a second embodiment of the second valve means which may be provided with the liquid conduit means. In this embodiment, first and second bypass valves 13 and 14, respectively, are placed in series with the expansion means of associated expansion/bypass means 3*d* and 4*d*. This arrangement may be more desirable, depending upon the precise configuration of indoor and outdoor heat exchange means 3 and 4, and depending upon whether they are already provided with expansion/bypass means or not.

Returning now to FIG. 5 of the drawings, it will be noted that control means have been provided for the refrigeration circuit disclosed which address a problem particular to refrigeration circuits of the type generally disclosed wherein a heated liquid is to be produced by the condensing of refrigerant vapor discharged by compressor means. Should the temperature within liquid heat exchange means 5 exceed certain predetermined limits, the discharge pressure developed by compressor means 2 will increase to a level such that damage or overloading thereof may occur. Applicant has addressed this problem through provision of means for sensing a condition indicative of the load imposed upon compressor means 2, that illustrated being a pressure sensor 17 in communication with the discharge port 2b of compressor means 2. It should be recognized, however, that other conditions could also be utilized as such an indication, including but not limited to the electrical current drawn by compressor means 2, discharge temperature, the overall pressure increase provided by compressor means 2, or the temperature within liquid heat exchange means 5.

The control means 18 provided by applicant are responsive to the signal generated by pressure sensing means 17 so as to open either first bypass valve 13 or second bypass valve 14 in response to a compressor load beyond a predetermined maximum. First bypass valve 13 would be actuated so as to admit condensed refrigerant to indoor heat exchange means 3 when operating in the third mode, while second bypass valve 14 would be opened when operating in the fourth mode so as to admit condensed refrigerant to outdoor heat exchange means 4. Preferably, control means 18 would include timing means for limiting the amount of time for which either bypass valve 13 or 14 is opened, thereby limiting the amount of condensed refrigerant withdrawn from the circuit. The result of withdrawing a portion of the refrigerant charge from the system is to reduce the overall capacity of the system and thereby reduce the operating load on the compressor. The refrigerant thus removed will be bled slowly back into the system it being remembered that the inactive heat exchange means during third or fourth mode operation is always vented to compressor suction. Thus, while the system capacity will be at least temporarily reduced, this is preferable to operating the compressor means at an overloaded condition. No specific details of control means 18 are believed required in that it is contemplated that same could take the form of electro-mechanical, solid-state electronic, or microcomputer based controls; all of which are known to those skilled in the art and could readily be designed for a specific application. Moreover, it is likely that the control means would be integrated with other control functions of the refrigeration circuit, preferably including microcomputer, based, programmed functions.

While the invention has been described above with respect to a preferred embodiment, it is to be understood that modifications thereto will become apparent to those skilled in the art, which modifications lie within the scope of the present invention, as defined in the claims which follow.

I claim:

1. A refrigeration circuit for the heating or cooling of a space, the production of a heated liquid, or the simultaneous cooling of a space and production of a heated liquid, the circuit comprising a. compressor means for compressing a refrigerant vapor and having a suction port and a discharge port;

b. indoor heat exchange means for transferring heat between refrigerant and a space to be heated or cooled, and having first and second refrigerant flow connections;

c. outdoor heat exchange means for transferring heat between refrigerant and a heat sink, and having first and second refrigerant flow connections;

d. liquid heat exchange means for transferring heat from refrigerant to a liquid, and having first and second refrigerant flow connections;

e. vapor conduit means including first valve means connected between the suction and discharge ports of said compressor means and the first refrigerant flow connections of said indoor, outdoor, and liquid heat exchange means; and liquid conduit means including second valve means connected to the second flow connections of said indoor, outdoor, and liquid heat exchange means; said first and second valve means being selectively positionable so as to direct refrigerant flow within the circuit in at least i. a first mode wherein said first valve means direct high pressure refrigerant vapor from said discharge port to said indoor heat exchange means via its first flow connection and direct low pressure refrigerant vapor from said outdoor heat exchange means via its first flow connection to said suction port, said first valve means further placing said liquid heat exchange means in communication with said suction port; and wherein said second valve means direct condensed refrigerant from said indoor heat exchange means via its second flow connection to said outdoor heat exchange means via its second flow connection, while preventing flow into said liquid heat exchange means via its second flow connection; whereby said indoor heat exchange means are operative to condense the high pressure refrigerant vapor and transfer heat therefrom to a space to be heated and said outdoor heat exchange means are operative to evaporate condensed refrigerant and absorb heat from a heat sink;

ii. a second mode wherein said first valve means direct high pressure refrigerant vapor from said discharge port to said outdoor heat exchange means via its first flow connection and direct low pressure refrigerant vapor from said indoor heat exchange means via its first flow connection to said suction port, said first valve means further placing said liquid heat exchange means in communication with said suction port; and wherein said second valve means direct condensed refrigerant from said outdoor heat exchange means via its second flow connection to said indoor heat exchange means via its second flow connection while preventing flow into said liquid heat exchange means via its second flow connection; whereby said outdoor heat exchange means are operative to condense the high pressure refrigerant vapor and transfer heat therefrom to a heat sink and said indoor heat exchange means are operative to evaporate condensed refrigerant and absorb heat from a space to be cooled.

iii. a third mode wherein said first valve means direct high pressure refrigerant vapor from said discharge port to said liquid heat exchange means via its first flow connection and direct low pressure refrigerant vapor from said outdoor heat exchange means via its first flow connection to said suction port, said first valve means further placing said indoor heat exchange means in communication with said suction port; and wherein said second valve means direct condensed refrigerant from said liquid heat exchange means via its second flow connection to said outdoor heat exchange means via its second flow connection while preventing flow into said indoor heat exchange means via its second flow connection; whereby said liquid heat exchange means are operative to condense the high pressure refrigerant vapor and transfer heat therefrom to a liquid and said outdoor heat exchange means are operative to evaporate condensed refrigerant and absorb heat from a heat sink; and iv. a fourth mode wherein said first valve means are operative to direct high pressure refrigerant vapor from said discharge port to said liquid heat exchange means via its first flow connection and direct low pressure refrigerant vapor from said indoor heat exchange means via its first flow connection to said suction port, said first valve means further placing said outdoor heat exchange means in communication with said suction port; and wherein said second valve means direct condensed refrigerant from said liquid heat exchange means via its second flow connection to said indoor heat exchange means via its second flow connection while preventing flow into said outdoor heat exchange means via its second flow connection; whereby said liquid heat exchange means are operative to condense the high pressure refrigerant vapor and transfer heat therefrom to a liquid and said indoor heat exchange means are operative to evaporate condensed refrigerant and absorb heat from a space to be cooled.

2. The refrigeration circuit of claim 1 wherein a. said first valve means comprise first and second four-way valves, each having first, second, third, and fourth ports, and a selectively positionable valve member for providing communication between said first and second ports and between said third and fourth ports when in a first position; and between said second and third ports and between said first and fourth ports when in a second position thereof; and b. said vapor conduit means provide communication between i. the discharge port of said compressor means and the first port of said first four-way valve;

ii. the second port of said first four-way valve and the first flow connection of said liquid heat exchange means;

iii. the third port of said first four-way valve and the suction port of said compressor means;

iv. the fourth port of said first four-way valve and the fourth port of said second four-way valve;

v. the first port of said second four-way valve and the first flow connection of said indoor heat exchange means;

vi. the second port of said second four-way valve and the suction port of said compressor means; and vii. the third port of said second four-way valve and the first flow connection of said outdoor heat exchange means; whereby, during operation in said first through fourth modes, said first and second four-way valves are selectively positioned as follows:

| | position of first four-way valve | position of second four-way valve |
|---|---|---|
| first mode | second | second |
| second mode | second | first |
| third mode | first | second |
| fourth mode | first | first |

3. The refrigeration circuit of claim 2 wherein said vapor conduit means providing communication between the third port of said first four-way valve and the suction port of said compressor means include means for partially restricting the flow of refrigerant vapor therethrough.

4. The refrigerant circuit of claims 1, 2, or 3 wherein said indoor and outdoor heat exchange means comprise coils of the fin-and-tube type and further include fan means for directing air in heat exchange relation therewith.

5. The refrigeration circuit of claims 1, 2, or 3 further comprising control means including a. means for sensing a condition indicative of the load imposed upon said compressor means; and b. means for actuating said second valve means so as to admit condensed refrigerant to said indoor heat exchange means when operating in said third mode, and to said outdoor heat exchange means when operating in said fourth mode, in response to a load beyond a predetermined maximum, whereby the load on said compressor means is reduced.

6. The refrigeration circuit of claim 1, 2, or 3 wherein said liquid conduit means interconnect the second flow connections of said indoor, outdoor, and liquid heat exchange means and wherein said second valve means include a. at least a first check valve for preventing flow into the second flow connection of said indoor heat exchange means and selectively operable bypass valve means connected in parallel therewith;

b. at least a second check valve for preventing flow into the second flow connection of said outdoor heat exchange means and selectively operable bypass valve means connected in parallel therewith; and c. a third check valve for preventing flow into the second flow connection of said liquid heat exchange means.

7. The refrigerant circuit of claim 6 wherein said selectively operable bypass valve means comprise a first bypass valve connected in parallel with said first check valve and a second bypass valve connected in parallel with said second check valve.

8. The refrigeration circuit of claim 7 further comprising control means including a. means for sensing a condition indicative of the load imposed upon said compressor means; and b. means for actuating said first bypass valve so as to admit condensed refrigerant to said indoor heat exchange means when operating in said third mode, and for actuating said second bypass valve so as to admit condensed refrigerant to said outdoor heat exchange means when operating in said fourth mode, in response to a load beyond a predetermined maximum, whereby the load on said compressor means is reduced.

9. The refrigeration circuit of claim 6 wherein each of said indoor and outdoor heat exchange means include expansion/bypass means at its second flow connection for reducing the pressure of condensed refrigerant flowing into the heat exchange means while permitting relatively unobstructed flow of condensed refrigerant out of the heat exchange means.

10. A refrigerant circuit comprising a. compressor means for compressing a refrigerant vapor and having a suction port and a discharge port;

b. indoor heat exchange means for transferring heat between refrigerant and a space, and having first and second refrigerant flow connections;

c. outdoor heat exchange means for transferring heat between refrigerant and a heat sink, and having first and second refrigerant flow connections;

d. liquid heat exchange means for transferring heat from refrigerant to a liquid, and having first and second refrigerant flow connections;

e. vapor conduit means including first valve means connected between the suction and discharge ports of said compressor means and the first refrigerant flow connections of said indoor, outdoor, and liquid heat exchange means; and liquid conduit means including second valve means connected to the second flow connections of said indoor, outdoor, and liquid heat exchange means; said first and second valve means being selectively positionable so as to direct refrigerant flow within the circuit in at least three of the following modes:

i. a first mode wherein said first valve means direct high pressure refrigerant vapor from said discharge port to said indoor heat exchange means via its first flow connection and direct low pressure refrigerant vapor from said outdoor heat exchange means via its first flow connection to said suction port, said first valve means further placing said liquid heat exchange means in communication with said suction port; and wherein said second valve means direct condensed refrigerant from said indoor heat exchange means via its second flow connection to said outdoor heat exchange means via its second flow connection, while preventing flow into said liquid heat exchange means via its second flow connection; whereby said indoor heat exchange means are operative to condense the high pressure refrigerant vapor and transfer heat therefrom to a space to be heated and said outdoor heat exchange means are operative to evaporate condensed refrigerant and absorb heat from a heat sink;

ii. a second mode wherein said first valve means direct high pressure refrigerant vapor from said discharge port to said outdoor heat exchange means via its first flow connection and direct low pressure refrigerant vapor from said indoor heat exchange means via its first flow connection to said suction port, said first valve means further placing said liquid heat exchange means in communication with said suction port; and wherein said second valve means direct condensed refrigerant from said outdoor heat exchange means via its second flow connection to said indoor heat exchange means via its second flow connection while preventing flow into said liquid heat exchange means via its second flow connection; whereby said outdoor heat exchange means are operative to condense the high pressure refrigerant vapor and transfer heat therefrom to a heat sink and said indoor heat exchange means are operative to evaporate condensed refrigerant and absorb heat from a space to be cooled;

iii. a third mode wherein said first valve means direct high pressure refrigerant vapor from said discharge port to said liquid heat exchange means via its first flow connection and direct low pressure refrigerant vapor from said outdoor heat exchange means via its first flow connection to said suction port; said first valve means further placing said indoor heat exchange means in communication with said suction port; and wherein said second valve means direct condensed refrigerant from said liquid heat exchange means via its second flow connection to said outdoor heat exchange means via its second flow connection while preventing flow into said indoor heat exchange means via its second flow connection; whereby said liquid heat exchange means are operative to condense the high pressure refrigerant vapor and transfer heat therefrom to a liquid and said outdoor heat exchange means are operative to evaporate condensed refrigerant and absorb heat from a heat sink; and iv. a fourth mode wherein said first valve means are operative to direct high pressure refrigerant vapor from said discharge port to said liquid heat exchange means via its first flow connection and direct low pressure refrigerant vapor from said indoor heat exchange means via its first flow connection to said suction port, said first valve means further placing said outdoor heat exchange means in communication with said suction port; and wherein said second valve means direct condensed refrigerant from said liquid heat exchange means via its second flow connection while preventing flow into said outdoor heat exchange means via its second flow connection; whereby said liquid heat exchange means are operative to condense the high pressure refrigerant vapor and transfer heat therefrom to a liquid and said indoor heat exchange means are operative to evaporate condensed refrigerant and absorb heat from a space to be cooled.

11. A refrigeration circuit comprising a. compressor means for compressing a refrigerant vapor and having a suction port and a discharge port;

b. indoor heat exchange means for transferring heat between refrigerant and a space, and having first and second refrigerant flow connections;

c. outdoor heat exchange means for transferring heat between refrigerant and a heat sink, and having first and second refrigerant flow connections;

d. liquid heat exchange means for transferring heat from refrigerant to a liquid, and having first and second refrigerant flow connections;

e. first and second four-way valves, each having first, second, third, and fourth ports, and a selectively positionable valve member for providing communication between said first and second ports and between said third and fourth ports when in a first position; and between said second and third ports and between said first and fourth ports when in a second position;

f. vapor conduit means providing communication between i. the discharge port of said compressor means and the first port of said first four-way valve;

ii. the second port of said first four-way valve and the first flow connection of said liquid heat exchange means;

iii. the third port of said first four-way valve and the suction port of said compressor means;

iv. the fourth port of said first four-way valve and the fourth port of said second four-way valve;

v. the first port of said second four-way valve and the first flow connection of said in vi. the second port of said second four-way valve and the suction port of said compressor means; and vii. the third port of said second four-way valve and the first flow connection of said outdoor heat exchange means; and f. liquid conduit means including second valve means interconnecting the second flow connections of said indoor, outdoor, and liquid heat exchange means.

12. The refrigeration circuit of claim 11 wherein said vapor conduit means providing communication between the third port of said first four-way valve and the suction port of said compressor means include means for partially restricting the flow of refrigerant vapor therethrough.

* * * * *

UNITED STATES PATENT AND TRADEMARK OFFICE

CERTIFICATE OF CORRECTION

PATENT NO. : 4,299,098

DATED : November 10, 1981

INVENTOR(S) : Gregory S. Derosier

It is certified that error appears in the above-identified patent and that said Letters Patent are hereby corrected as shown below:

In claim 11, subparagraph (f) (v), delete "in" and substitute therefor --indoor heat exchange means;--.

Signed and Sealed this

*Twenty-third* Day of *February 1982*

[SEAL]

*Attest:*

GERALD J. MOSSINGHOFF

*Attesting Officer*

*Commissioner of Patents and Trademarks*